US012091798B2

(12) United States Patent
Scatizzi

(10) Patent No.: US 12,091,798 B2
(45) Date of Patent: Sep. 17, 2024

(54) EQUIPMENT FOR THE COLLECTION AND THE CONTROLLED DELIVERY OF LIQUIDS WITH VOLUMETRIC DOSAGE

(71) Applicant: TECNORAMA S.R.L., Prato (IT)

(72) Inventor: Mario Scatizzi, Pistoia (IT)

(73) Assignee: TECNORAMA S.R.L., Prato (IT)

( * ) Notice: Subject to any disclaimer, the term of this patent is extended or adjusted under 35 U.S.C. 154(b) by 412 days.

(21) Appl. No.: 17/609,328

(22) PCT Filed: Apr. 1, 2020

(86) PCT No.: PCT/IT2020/050084

§ 371 (c)(1),
(2) Date: Nov. 5, 2021

(87) PCT Pub. No.: WO2020/225836

PCT Pub. Date: Nov. 12, 2020

(65) Prior Publication Data

US 2022/0213629 A1 Jul. 7, 2022

(30) Foreign Application Priority Data

May 7, 2019 (IT) ..... 102019000006584

(51) Int. Cl.
*D06B 23/10* (2006.01)
*D06B 23/20* (2006.01)

(52) U.S. Cl.
CPC ..... *D06B 23/10* (2013.01); *D06B 23/205* (2013.01)

(58) Field of Classification Search
CPC ..... D06B 23/10
See application file for complete search history.

(56) References Cited

U.S. PATENT DOCUMENTS 4,852,620 A * 8/1989 Jakubowicz ..... B01L 3/021 422/922
6,302,168 B1 10/2001 Hu

FOREIGN PATENT DOCUMENTS

CN 1404908 A 3/2003
EP 0 602 737 A1 6/1994
(Continued)

OTHER PUBLICATIONS

International Search Report and Written Opinion of the International Searching Authority issued on Jul. 17, 2020 in corresponding International application No. PCT/IT2020/050084; 11 pages.
(Continued)

*Primary Examiner* — Rita P Adhlakha
(74) *Attorney, Agent, or Firm* — Maier & Maier, PLLC

(57) ABSTRACT

Apparatus for the controlled withdrawal and dispensing of liquids, comprising a structure (S) with a platform (1) housing a first series of containers (2) containing liquid substances and a second series of containers (3) adapted to receive the substances of the containers of the first series, the apparatus further comprising means for withdrawing the liquids from the containers of the first series and dispensing such liquids into the containers of the second series. On each container of the first series is inserted a half-pipette consisting of a barrel (4), a piston (5) devoid of actuation rod, and a needle (6). The withdrawing and dispensing means comprise a unit (9) provided with a vertical rod (95, 96) for actuating the piston of each half-pipette, said unit being constrained to a carriage (10) that can be moved above the platform. The unit (9) is movable vertically from and towards the platform (1).

6 Claims, 7 Drawing Sheets

(56) References Cited

FOREIGN PATENT DOCUMENTS

| | | |
|---|---|---|
| EP | 0 945 728 A2 | 9/1999 |
| EP | 1 402 952 A1 | 3/2004 |

OTHER PUBLICATIONS

International Preliminary Report on Patentability issued on Jan. 20, 2021 in corresponding International application No. PCT/IT2020/050084; 11 pages.

* cited by examiner

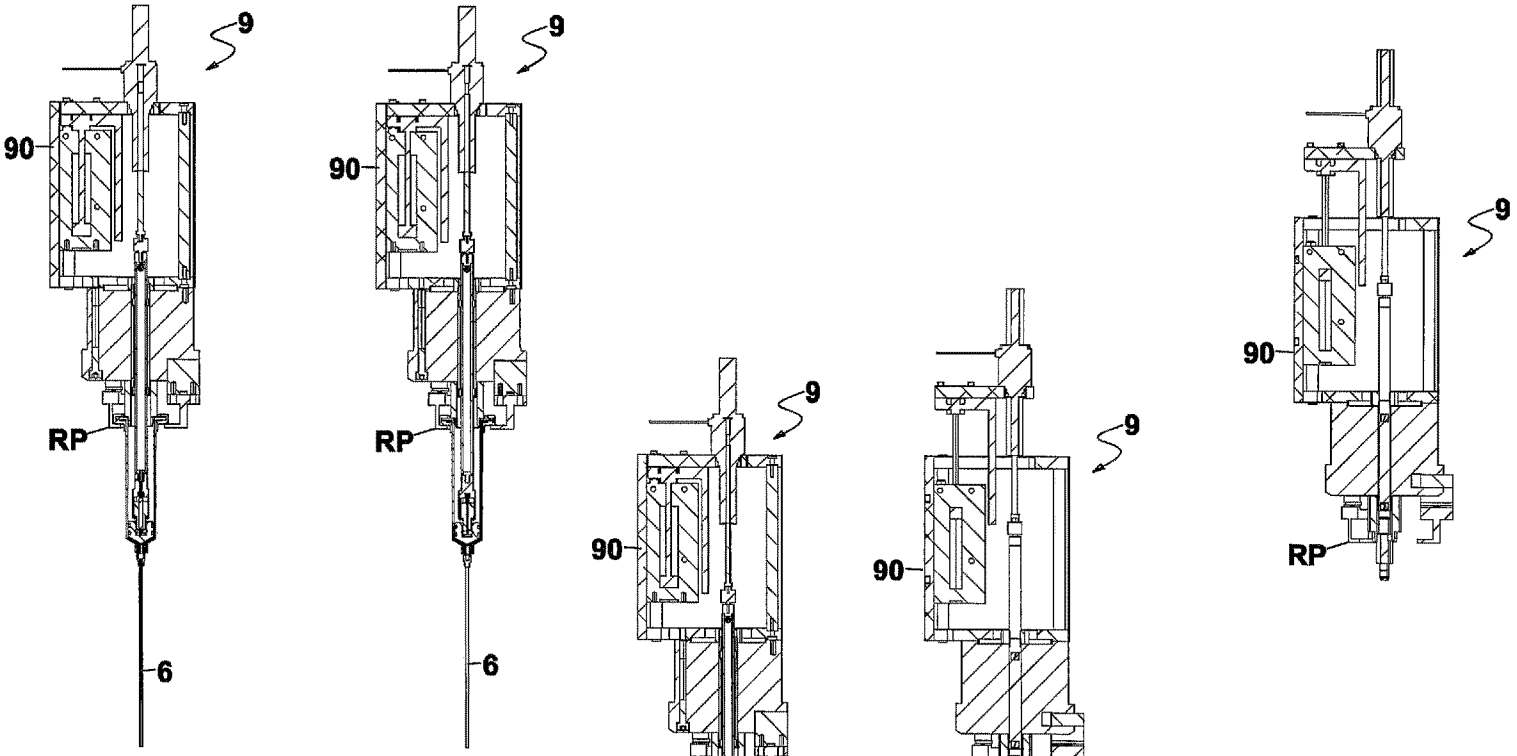
FIG.7D
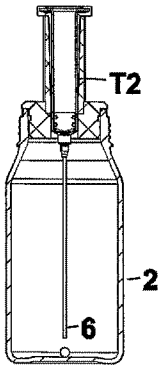
FIG.8A
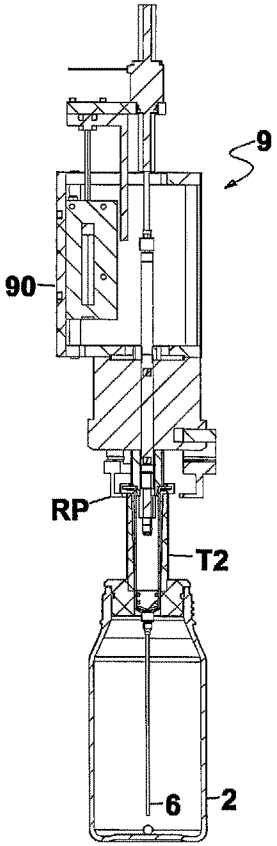
FIG.8B
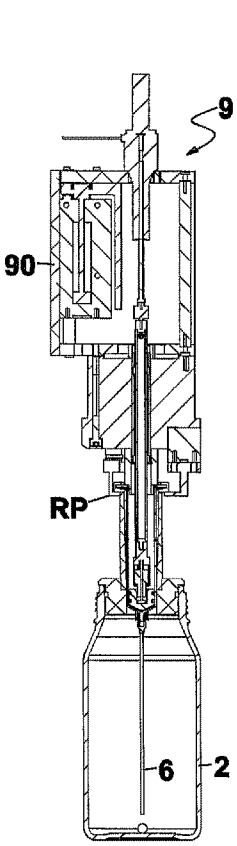
FIG.8C
FIG.8D

EQUIPMENT FOR THE COLLECTION AND THE CONTROLLED DELIVERY OF LIQUIDS WITH VOLUMETRIC DOSAGE

The present invention relates to an apparatus for the controlled withdrawal and delivery of liquids with volumetric dosage, in particular, although not exclusively, for the preparation of dyeing solutions for the textile industry.

EP0602737 discloses an apparatus for the controlled withdrawal and delivery of liquids with volumetric dosage comprising a structure with a platform on which, in a first position, several containers containing liquid substances are positioned and, in a second position on the same platform, there are further containers intended to receive predetermined doses of the liquids contained in the containers of the first station. The withdrawal of liquids from the containers of the first station and the dosage of the same liquids in the containers of the second station are operated by means of a syringe connected to a carriage which moves it above the aforementioned platform according to a work program managed by a programmable control unit. This system has the disadvantage of requiring washing of the syringe with a suitable solvent after each use to avoid contamination of the liquids contained in the containers of the first station. This. on the one hand, requires excessive operating times compared to current production needs and, on the other hand, does not guarantee that, after washing, the syringe is completely free of residues of the solvent used for washing. In addition, each washing is associated with a loss of the liquid contained in the syringe, which negatively affects the economy of the process also because it requires special treatments of the substances produced by repeated washing of the syringe.

EP0945728 discloses an apparatus for the controlled withdrawal and delivery of liquids with volumetric dosage, comprising a support structure suitable for receiving a first series of containers containing liquid substances and a second series of containers suitable for receiving one or more of said substances in predetermined doses, and automatic means of taking the substances from the containers of the first series and dispensing predetermined doses of the same substances into the containers of the second series. The pick-up and delivery means comprise a plurality of individual pick-up and delivery members positioned in correspondence with each of said containers and resolvably coupled with a unit for activating and moving said members. In an embodiment described in EP0945728, said individual members are syringes each arranged in correspondence with a container of the first series, so that each container of the first series is associated with a corresponding syringe. Although this system avoids washing of each syringe before its use, it entails relatively high costs due to the need to prepare a syringe in correspondence with each container of the first series.

U.S. Pat. No. 6,302,168B1 discloses an automated liquid metering apparatus using injectors as metering devices is provided. The apparatus mainly includes a plurality of storage containers uniformly spaced on a plane in multiple rows. Each storage container is sealed with a cap and has a loadstone disposed therein. A stirring means is located below the storage containers to cause the loadstones rotate and thereby evenly stir liquid in the storage containers. The cap of each storage container has at least one injector extended therethrough. A liquid sucking-releasing means mounted on a traveling means could be shifted to locate above a selected storage container under control of a control means. When the liquid sucking-releasing means is descended, it grabs the injector on the selected storage container, and when the same means is ascended, it causes the injector to suck in an amount of liquid from the selected storage container while extracting the same injector from the selected storage container. The extracted injector is then moved by the traveling means to a receptacle positioned on an electronic balance and caused by said liquid sucking-releasing means to release all the previously sucked liquid into the receptacle at where the liquid is precisely measured with the electronic balance. EP1402952A1 discloses a cartridge used with an analysis unit to study a fluid or gas, especially for medical diagnosis applications, having a cylindrical tank with an opening for the fluid/gas to be pumped in and out through a needle by a piston provided with an actuation rod. The actuation rod of the piston has a connector for a drive to move the piston to and fro. The connector and the drive are structured so that they are closed during a longitudinal movement along one section of the tank and are released on a reverse movement. The connection remains closed during movement along a second section of the tank.

CN1404908A discloses an equipment with combined measuring system for automatically-preparing solution. Said equipment comprises a structure with working table, on the working table one or several containers for solid product, one or several bottle containers for liquid products, one or several containers for solution and one or several empty and clean bottle containers can be placed, a bearing device can be moved on the working table, and is characterized by that it also includes a device connected with bearing device to move and treat the described bottles, and move, treat and drive at least container for solid product, and another device for preparing solution and/or mixture by using solid product.

The above-mentioned documents disclose apparatuses that use delivery means including pumps entirely formed therein, which entails excessive costs in relation to the current production needs.

The main purpose of the present invention is to overcome the aforementioned drawbacks.

This result has been achieved, in accordance with the present invention, by providing an apparatus having the characteristics indicated in claim 1. Other features of the present invention are the subject of the dependent claims.

Thanks to the present invention, it is possible to realize an apparatus for the controlled withdrawal and delivery of liquids with volumetric dosage that avoids the contamination of the liquids contained in the starting containers and that, at the same time, has a simplified overall structure and a relatively small manufacturing cost.

These and further advantages and characteristics of the present invention will be more and better understood by each person skilled in the art thanks to the description that follows and the annexed drawings, provided by way of example but not to be considered in a limiting sense, in which.

Figure 1:
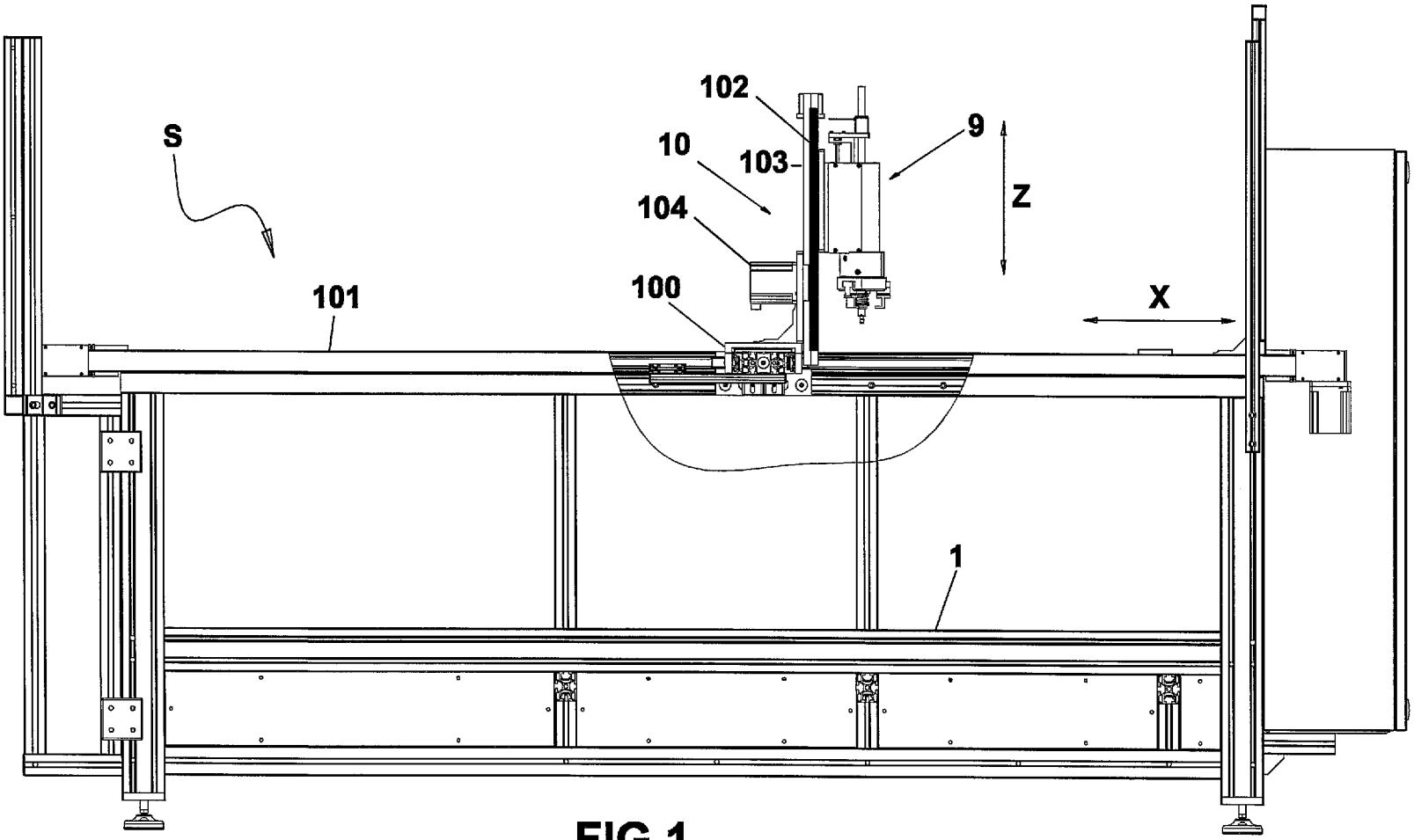
FIG. 1 represents a side view of an apparatus according to the present invention.
Figure 2:
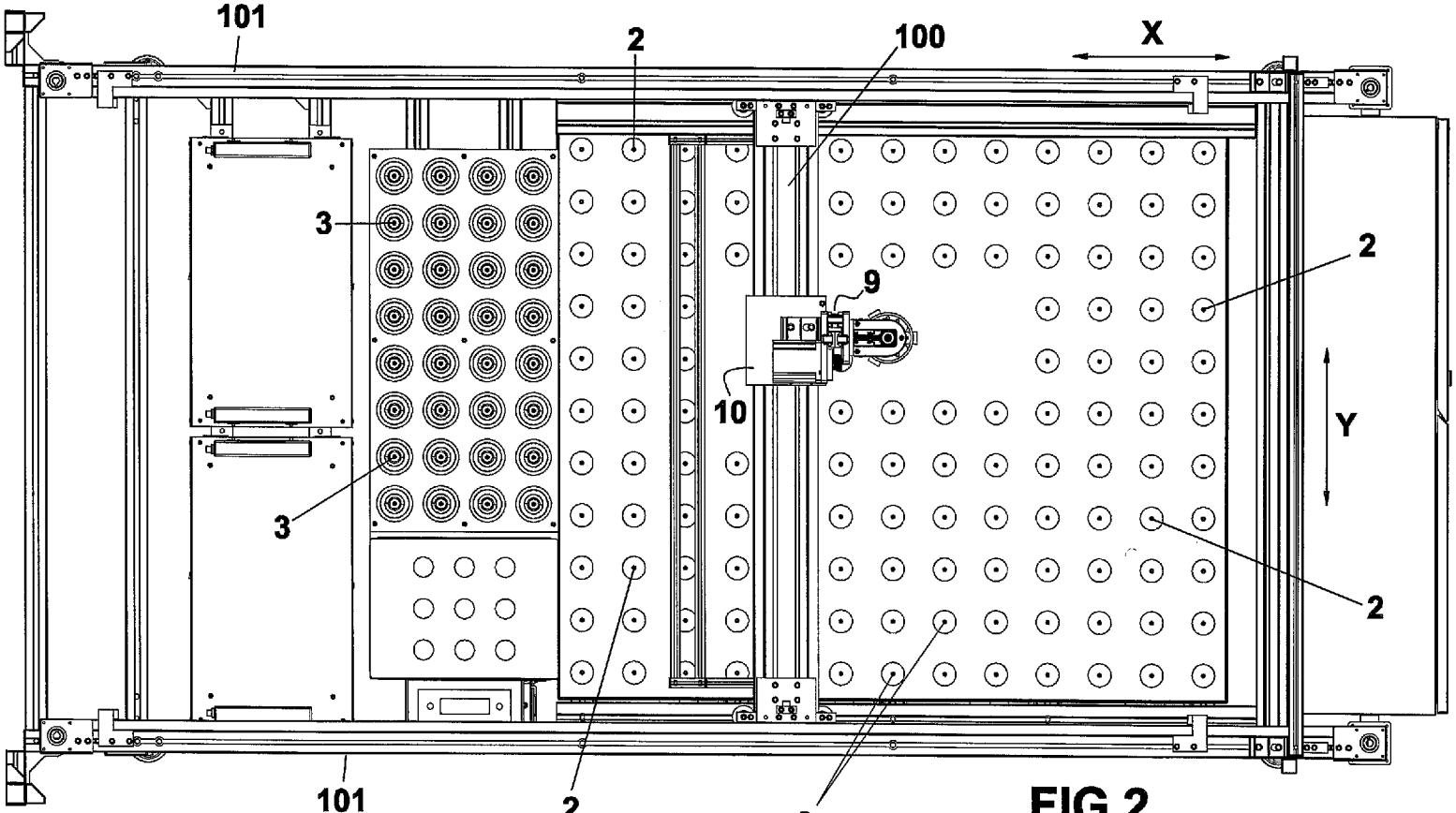
FIG. 2 represents a top plan view of the equipment shown in FIG. 1.
Figure 5:
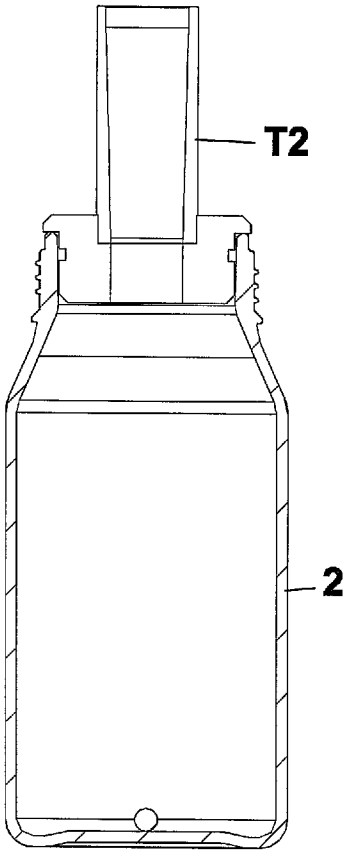
FIG. 5 represents only the container (2) with an adapter for positioning the respective half-pipette.
Figure 4:
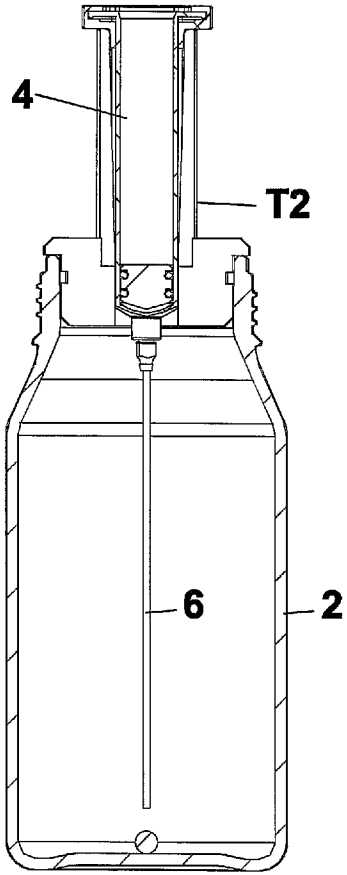
FIG. 4 represents a semi-pipette inserted in a container (2) containing a liquid substance.
Figure 3:
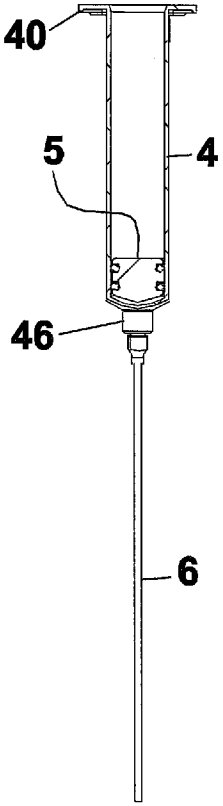
FIG. 3 represents a schematic vertical sectional view of a half-pipette usable in an apparatus according to the present invention.
Figures 6A, 6B, 6C, 6D, 6E:
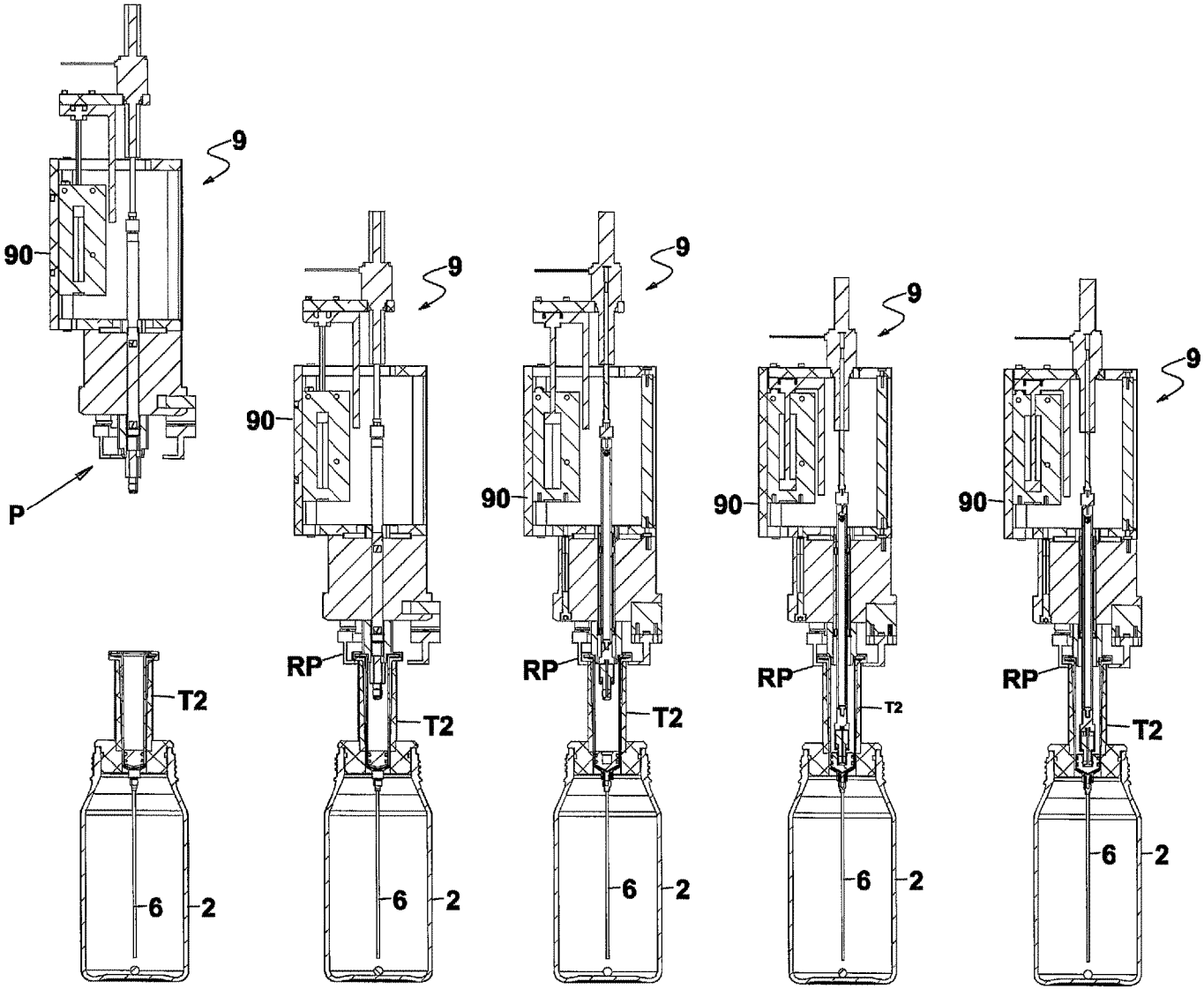
Figure 11:
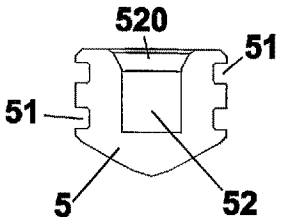
Figure 10:
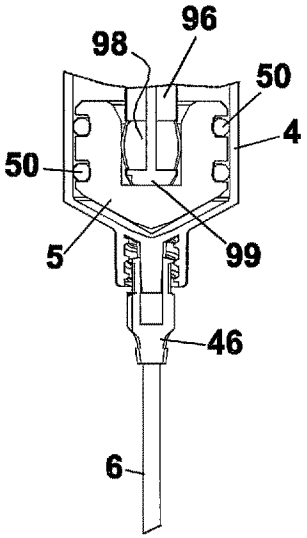
Figure 9:
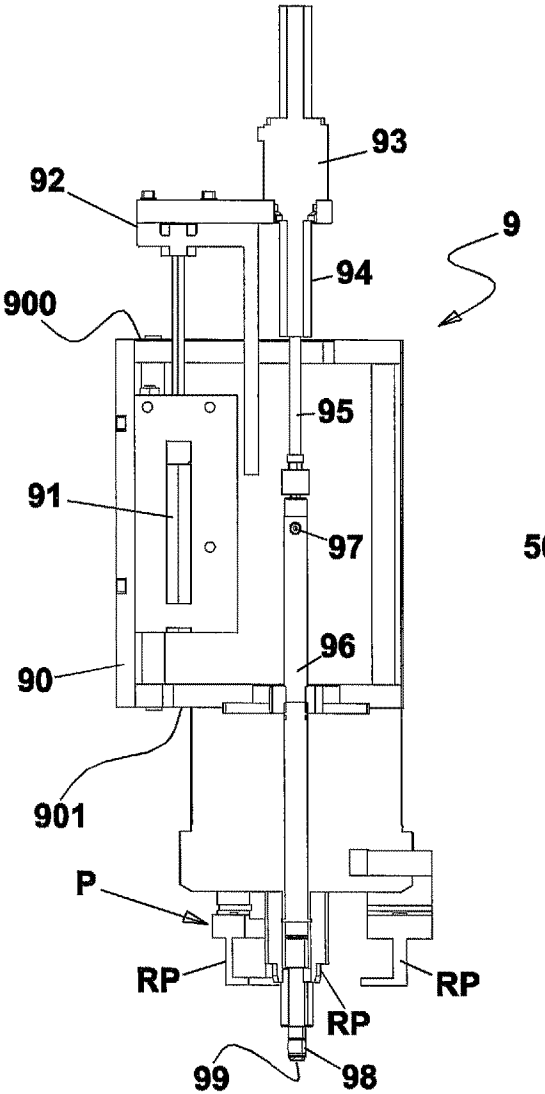

FIGS. 6A-6G schematically represent a sequence of phases relating to the withdrawal of a dose of a liquid substance from a container (2);

FIGS. 7A-7D schematically represent a sequence of phases relating to the dosage of a liquid substance in a different container (3);

FIGS. 8A-8D schematically represent the repositioning of a half-pipette in the respective container (2);

FIG. 9 is a detail of FIG. 6A;

FIG. 10 is a detail of FIG. 6D which illustrates the expanded structure of the pad (98) in the piston (5) of a half-pipette;

FIG. 11 represents a schematic vertical section view of a piston (5).

Reduced to its essential structure and with reference to the attached drawings, an apparatus for the collection and controlled delivery of liquids with volumetric dosage in accordance with the present invention is of the type comprising a structure (S) on which is arranged a platform (1) suitable for housing a first series of containers (2) containing liquid substances intended to be used for the preparation of solutions and a second series of containers (3) suitable for receiving predetermined doses of the substances contained in the containers (2) of the first series. The apparatus further comprises means for removing liquids from the containers (2) of the first series and dispensing predetermined doses of said liquids into the containers (3) of the second series.

Said solutions are intended, for example, for the preparation of dyeing liquids for the textile industry, or also for the preparation of pharmaceutical, food or cosmetic formulations.

In accordance with the present invention, a barrel (4) of a syringe or "pipette" with relative piston (5) and needle (6) is applied on each container (2) of the first series. The piston (5) does not have the actuating stem. The needle (6) is of suitable length to be inserted into the respective container (2) and constitutes the element through which the liquid from the container (2) can be aspirated and injected. The lower part (46) of the barrel (4) defines a connection portion of the latter with the needle (6). In practice, the barrel (4), the piston (5) without the stem and the needle (6) constitute a syringe or pipette without the piston actuation rod which, in the context of the present description, is defined as "half -pipette". Each piston (5) is equipped with annular rubber gaskets (50), positioned in corresponding circumferential seats (51), which ensure that contact with the internal wall of the respective jacket (4) is kept tight. The needle (6) defines a lower extension of the barrel (4) through which the suction and delivery of liquids is performed. Each half-pipette (4, 5, 6) can be reversibly associated with an actuation rod for actuating the piston (5), the actuation rod being carried by a unit (9) connected to a carriage (10) arranged above the platform (1). The carriage (10) is mounted on a guide (100) which extends transversely to the structure (S) and which, in turn, is mounted on two guides (101) extending along the longitudinal edges of the same structure. Furthermore, the carriage (10) is enslaved to respective moving means (per se known to those skilled in the art and therefore not described in further detail) allowing the carriage to be moved along the transverse guide (100) and along the longitudinal guides (101). In this way, the unit (9) can be moved horizontally on the structure (S), i.e. above the platform (1), as schematically indicated by the double arrows "X" and "Y". The unit (9) is constrained to the carriage (10) by means of a vertical guide (102) arranged in a corresponding surface (103) of the same carriage (10) and is connected with an electric actuator (104) which controls its movement (Z) along said vertical guide (102). Therefore, the unit (9) can also be moved vertically, from and to the platform (1). It is understood that the mechanism for moving the unit (9) along said directions (X, Y, Z) can be of any other suitable type.

The unit (9) comprises a main body (90) connected to the carriage (10) by means of the vertical guide (102). Said body (90) is hollow and inside it there is mounted a vertical pneumatic actuator (91) whose stem passes through an upper wall (900) of the same body (90). An inverted "L" shaped bracket (92) is mounted on the actuator stem (91), the vertical section of which also passes freely through the upper wall (900) of the body (90). The horizontal section of the bracket (92) acts as a support for a stepper motor (93) whose shaft is vertical and oriented downwards. A nut screw bushing (94) is applied on the motor (93) and is engaged by the upper side of a correspondingly threaded rod (95). On the lower side of the rod (95) there is a tube (96) equipped with a radial hole (97) on which a flexible conduit (not visible in the drawings) is inserted to supply compressed air to the same tube (96). The tube (96) passes inside the body (90) and extends beyond the lower wall (901) of the latter. The rod (95) associated with the motor (93) passes through the upper wall (900) of the body (90). On the lower side of the tube (96) there is mounted an expandable pad (98) which expands when compressed air is fed into the tube (96). At the bottom, the tube (96) is closed and ends with a tip (99) intended to be inserted in each of the pistons (5) as further described below. In practice, while the actuator (104) controls the movement of the body (90) of the unit (9) along the guide (102), the actuator (91) controls the vertical movement of the motor (93) with respect to the body (90) and the motor (93) independently controls the vertical movement of the tube (96).

Therefore, the vertical movement of the tube (96) with respect to the containers positioned on the platform (1) can be controlled by the combined action of the actuator (104), the actuator (91) and the motor (93).

The set consisting of the rod (95) and the tube (96) constitutes the rod for driving the pistons (5) of the half-pipettes.

In the example shown in the attached drawings, the rod (95) and the tube (96) are vertical and coaxial with each other.

On its lower side, the body (90) is provided with a self-centering pneumatic radial gripper (P) with three radial jaws (RP) intended to engage and respectively release the half-pipettes as further described below. The gripper (P) is a component known per se. The jaws (RP) are preferably L-shaped to engage the upper collar (40) of each half-pipette as further described below.

Each piston (5) has a central cavity (52) on its side facing upwards. Preferably, said cavity (52) has a circular cross section to facilitate its engagement by the expandable pad (98).

Furthermore, preferably, the upper part (520) of the cavity (52) has a conical shape which favors and guides the entry of the tip (99) and the pad (98) into the same cavity.

The upper part (40) of the barrel (4) of the half-pipettes (4, 5, 6) is preferably shaped like a collar to facilitate its engagement by the jaws (RP) of the clamp (P). The upper part (40) of said barrel (4) is also able to rest on the upper edge of a tube (T2) that is positioned in each of the containers (2) and acts as an adapter support for the barrel itself when the latter is not engaged by the gripper (P). In practice, the tube (T2) allows to hold the half-pipette (4, 5, 6) in vertical position in the respective container (2).

A possible mode of operation of the apparatus described above is the following.

Figure 7C:
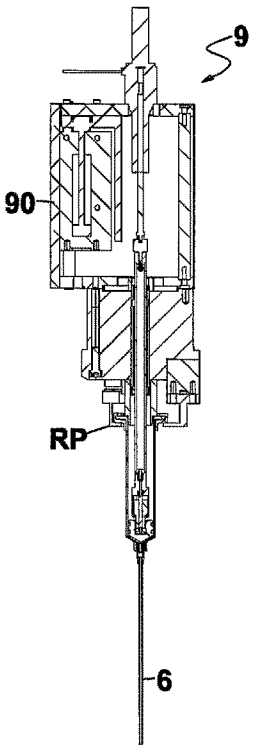
Figure 7C:
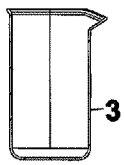
Figure 7B:
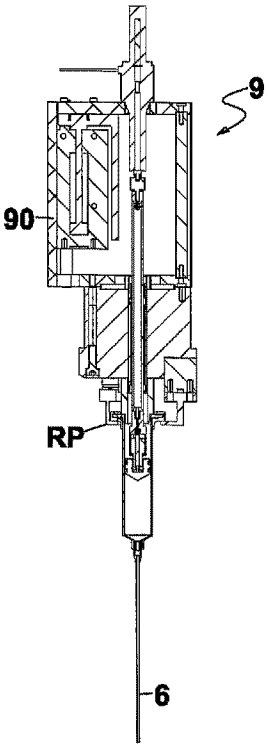
Figure 7B:
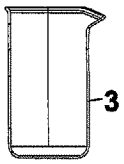
Figure 7A:
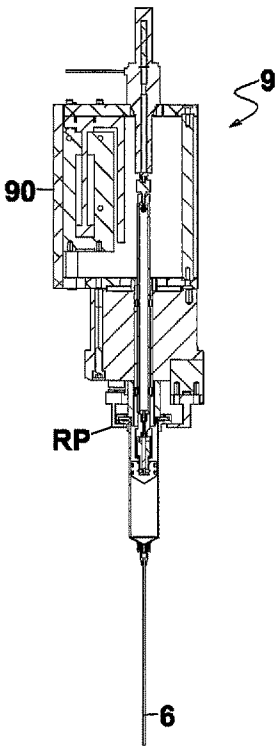
Figure 7A:
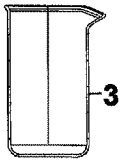
Figure 6G:
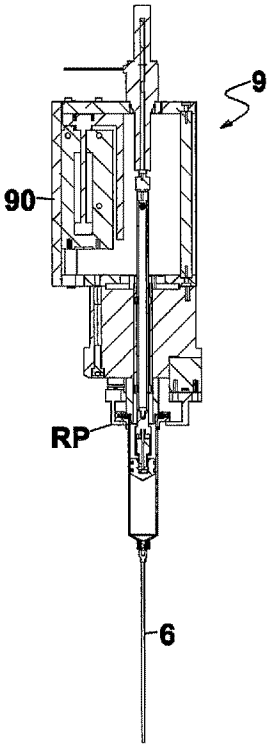
Figure 6G:
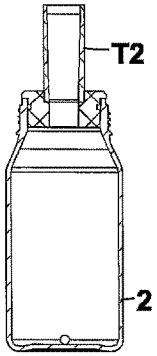
Figure 6F:
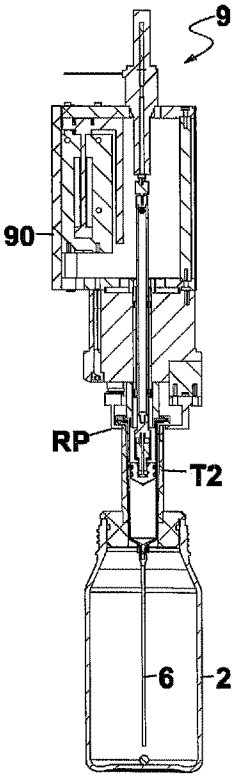

The carriage (10), controlled by a programmable electronic unit (not visible in the drawings) that moves it according to the dosages to be made, is brought over a container (2) containing the desired liquid and in which is inserted the respective semi-pipette (4, 5, 6). At this point, the actuator (104) commands the descent of the unit (9) towards the selected container (2), after which the actuator (91) commands the descent of the group (92, 93, 95, 96) with respect to the body (90) determining the insertion of the tip (99) and the pad (98) in the cavity (52) of the piston (5) of the half-pipette inserted in the selected container (2). Subsequently, the gripper (P) is activated and grasps the upper collar (40) of the barrel (4). Then, compressed air is fed into the tube (96), which determines the expansion of the pad (98) in the cavity (52). Therefore, the piston (5) is associated with the rod (95, 96). The subsequent lifting of the rod (95, 96) by the stepper motor (93) determines the withdrawal of a predetermined amount of liquid from the container (2). The aforementioned operations are schematically illustrated in FIGS. 6A-6F. At this point, as shown in FIG. 6G, the unit (9) is raised, in reverse movement to the previous one, and the carriage (10) carries the same unit (9), with the half-pipette (4, 5, 6) hooked by the clamp (P), in correspondence with a container (3) intended to receive a predetermined dose of the liquid sucked into the half-pipette, as shown in FIG. 7A. Then, as schematically illustrated in FIGS. 7B-7D, the unit (9) is lowered to a predetermined distance from the container (3), the pad (98) is deflated, interrupting the supply of compressed air into the tube (96), and the stepper motor activates the descent of the piston (5) for a value corresponding to the dose of liquid to be dispensed into the container (3). Once this operation is completed, the carriage (10) returns the unit (9) with the half-pipette (4, 5, 6) to the starting container (2) and, with reverse movements to the previous ones, the half-pipette (4, 5, 6) is repositioned on this container. Subsequently, the actuator (91) controls the lifting of the group (92, 93, 95, 96) and the clamp (P) releases the half-pipette (4, 5, 6).

Since a complete pipette is not associated with each container (2) but, on the contrary, a pipette without the piston actuation rod is associated, and only one actuation rod is used for the collection and delivery of the liquids, the overall cost of the apparatus is reduced with respect to known apparatuses. At the same time, since the rod for actuating the pistons contained in the half-pipettes does not come into contact with the liquids, there is no contamination and intermediate washes are not required.

In practice, the present apparatus comprises only one rod, i.e. the rod of the unit (9), adapted to engage and actuate each piston (5). As noted above, the pistons (5) are configured to be reversibly engaged by the rod of unit (9) and, vice versa, said rod is configured to reversibly engage the pistons (5). According to the example provided above, the cavity (52) of the pistons (5) is engaged by the rod provided by the unit (9) that, in turn, is adapted to engage said cavity (52). In more general terms, according to the present invention each piston (5) is provided with a surface directly and reversibly engageable by said rod, the latter being the only actuation rod for actuating each piston (5). It is noted that pistons (5) form a pumping device inside the respective barrels (4) only when they are engaged by the actuation rod provided by the unit (9).

Preferably, as previously described, the liquid dosage step is carried out after deflating the pad (98). This determines greater precision in the dosing phase since the elasticity due to the pneumatic expansion of the pad (98) is eliminated, so the pushing action exerted by the rod (96) is not affected by said elasticity.

The activation of the carriage (10) and the actuators mentioned above are controlled by a control unit of the type known to the industrial automation technicians.

Therefore, an apparatus for the controlled withdrawal and delivery of liquids with volumetric dosage, in accordance with the present invention, comprises a structure (S) on which a platform (1) is arranged to house a first series of containers (2) containing liquid substances destined to be picked up and dosed and a second series of containers (3) adapted to receive predetermined doses of the substances contained in the containers (2) of the first series, the apparatus further comprising means for withdrawing the liquids from the containers (2) of the first series and dispensing such liquids into the containers (3) of the second series in predetermined doses, on each container (2) of the first series being inserted a half-pipette consisting of a barrel (4) defining a volume which can be filled with the liquid of the respective container (2) of the first series, a piston (5) devoid of actuation rod and a needle (6) through which the liquid can be aspirated and injected, said means for withdrawing the liquids from the containers (2) of the first series and dispensing the liquids into the containers (3) of the second series comprising a unit (9) provided with a vertical rod (95, 96) adapted to engage and actuate the piston (5) of each half-pipette (4, 5, 6), said unit (9) being constrained to a carriage (10) that, in turn, can be moved above the platform (1), said unit (9) being movable vertically from and towards the platform (1).

Preferably, according to a possible embodiment of the present invention, said unit (9) is connected to said carriage (10) by means of a vertical guide (102) arranged in a corresponding surface (103) of the same carriage (10) and is connected to an electric actuator (104) that controls its movement (Z) along said vertical guide (102).

Moreover, preferably, the unit (9) comprises a hollow body (90) fixed to the carriage (10) by means of the vertical guide (102) and inside which said rod (95, 96) is positioned passing vertically therethrough, the latter being moved vertically inside the hollow body (90) by means of a corresponding actuator with a vertical axis (91).

Preferably, said vertical axis actuator (91) is positioned inside said hollow body (90).

Preferably, said rod (95, 96) comprises a first part (95) connected to an actuator (93) which controls its vertical movement and a second part constituted by a tubular body (96) in which air can be introduced for the expansion of an expandable pad (98) adapted to engage a cavity (52) provided inside each piston (5) when it is expanded due to the introduction of air in said second part (96).

Preferably, said tubular body (96) has a tip (99) provided below the expandable pad (98).

Preferably, said pad (98) engages said piston (5) only in a step of raising the piston itself.

In practice, the details of execution can however vary in an equivalent way as regards the individual elements described and illustrated, without thereby departing from the idea of the solution adopted and therefore remaining within the limits of the protection granted by this patent as defined by the attached claims.

The invention claimed is:

1. Apparatus for the controlled withdrawal and dispensing of liquids with volumetric dosage, comprising: a structure on which a platform houses a first series of containers containing liquid substances destined to be picked up and dosed and a second series of containers adapted to receive predetermined doses of the substances contained in the containers of the first series, the apparatus further comprising means for withdrawing the liquids from the containers of the first series and dispensing such liquids into the containers of the second series in predetermined doses, wherein on each container of the first series is inserted a half-pipette comprising a barrel defining a volume which can be filled with the liquid of the respective container of the first series, a piston devoid of actuation stem, and a needle through which the liquid can be aspirated and injected, and wherein said means for withdrawing the liquids from the containers of the first series and dispensing the liquids into the containers of the second series comprise a unit provided with a vertical rod adapted to engage and actuate the piston of each half-pipette, said unit being constrained to a carriage that, in turn, can be moved above the platform, said unit being movable vertically from and towards the platform, wherein said rod comprises a first part connected to an actuator which controls its vertical movement and a second part constituted by a tubular body in which air can be introduced for the expansion of an expandable pad adapted to engage a piston cavity provided on each piston when it is expanded due to the introduction of air in said second part, such that the expandable pad has an expanded configuration in which the expandable pad engages the piston cavity, and a non-expanded configuration in which the expandable pad does not engage the piston cavity.

2. Apparatus according to claim 1, wherein said unit is connected to said carriage by means of a vertical guide arranged in a corresponding surface of the same carriage and is connected to an electric actuator that controls its movement along said vertical guide.

3. Apparatus according to claim 1, wherein the unit comprises a hollow body fixed to the carriage by means of a vertical guide inside which said rod is positioned passing vertically therethrough, the latter being moved vertically inside the hollow body by means of a corresponding actuator with a vertical axis.

4. Apparatus according to claim 3, wherein said vertical axis actuator is positioned inside said hollow body.

5. Apparatus according to claim 1, wherein said tubular body has a tip provided below the expandable pad.

6. Apparatus according to claim 1, wherein said expandable pad is in the expanded configuration to engages said piston cavity in a step of raising the piston itself and the expandable pad is in the non-expanded configuration in a step of dispensing the liquids into the containers of the second series.

* * * * *